US009805649B2

(12) United States Patent
Kawae et al.

(10) Patent No.: US 9,805,649 B2
(45) Date of Patent: Oct. 31, 2017

(54) DISPLAY DEVICE AND DRIVING METHOD THEREOF

(71) Applicant: SAMSUNG DISPLAY CO., LTD., Yongin, Gyeonggi-do (KR)

(72) Inventors: Daisuke Kawae, Yokohama (JP); Ryo Ishii, Yokohama (JP); Masayuki Kumeta, Yokohama (JP)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 456 days.

(21) Appl. No.: 14/450,775

(22) Filed: Aug. 4, 2014

(65) Prior Publication Data

US 2015/0035871 A1 Feb. 5, 2015

(30) Foreign Application Priority Data

Aug. 5, 2013 (JP) ..... 2013-162327

(51) Int. Cl.
*G09G 3/32* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0814* (2013.01); *G09G 2320/0223* (2013.01)

(58) Field of Classification Search
None
See application file for complete search history.

(56) References Cited

U.S. PATENT DOCUMENTS 6,421,038 B1 * 7/2002 Lee ..... G09G 3/3677 345/87
8,976,103 B2 * 3/2015 Ino ..... G09G 3/3648 345/100
2001/0007447 A1 * 7/2001 Tanaka ..... G09G 3/3258 345/87
2005/0219166 A1 * 10/2005 Kim ..... G09G 3/3241 345/76
2007/0115225 A1 * 5/2007 Uchino ..... G09G 3/3233 345/76
2011/0018846 A1 * 1/2011 Hu ..... G02F 1/136286 345/204
2013/0106817 A1 5/2013 Gang et al.

FOREIGN PATENT DOCUMENTS

EP 1529276 B1 5/2005
JP 08-087248 4/1996

* cited by examiner

*Primary Examiner* — Kent Chang
*Assistant Examiner* — Benjamin Morales Fernande
(74) *Attorney, Agent, or Firm* — Lee & Morse, P.C.

(57) ABSTRACT

A display device includes a plurality of pixels, a gate control line electrically connected to the pixels, an auxiliary power line isolated from the gate control line, and a number of auxiliary switches between the gate control line and the auxiliary power line. The at least one auxiliary switch is controlled by an auxiliary control line isolated from the auxiliary power line and the gate control line. The at least one auxiliary switch electrically connects the gate control line and the auxiliary power line.

20 Claims, 4 Drawing Sheets

DISPLAY DEVICE AND DRIVING METHOD THEREOF

CROSS-REFERENCE TO RELATED APPLICATION

Japanese Patent Application No. 2013-162327, filed on Aug. 5, 2013, and entitled: "Display Device and Driving Method Thereof," is incorporated by reference herein in its entirety.

BACKGROUND

1. Field

One or more embodiments described herein relate to a display device and a method for driving a display device.

2. Description of the Related Art

A variety of flat panel displays have been developed to replace CRT displays. One example of a flat panel display is an organic electroluminescent (EL) display. These displays have receive significant attention because of their thin profile and low-power requirements.

Organic EL displays have been used electrical systems of all shapes and sizes. Examples or large electrical systems which use organic EL displays include televisions and electric signs. Examples of small and medium electrical systems include personal computers, smart phones, and tablet terminals.

SUMMARY

In accordance with one embodiment, a display device includes a plurality of pixels; a gate control line electrically connected to the pixels; an auxiliary power line isolated from the gate control line; and a number of auxiliary switches between the gate control line and the auxiliary power line, wherein the at least one auxiliary switch is to be controlled by an auxiliary control line isolated from the auxiliary power line and the gate control line, and wherein the at least one auxiliary switch electrically connects the gate control line and the auxiliary power line.

A number of the auxiliary switches may be less than a number of the pixels. The number is at least one. The auxiliary switches may be provided for every N pixels, where N is an integer more than 5 and less than 20.

Each of the pixels may include a light-emitting element; and a driving transistor is to control an amount of current flowing to the light-emitting element to achieve to a corresponding gray scale value.

Each of the pixels may include a selection transistor controlled by the gate control line, and signals supplied to the selection transistor and the auxiliary switches during a horizontal period are different from each other.

Each of the pixels may include a selection transistor controlled by the gate control line, and signals supplied to the selection transistor and the auxiliary switches during a horizontal period are substantially equal to each other.

An auxiliary voltage may be applied to the auxiliary power line before a signal for turning on the auxiliary switches is supplied to the auxiliary control line. The gate control line, the auxiliary control line, and the auxiliary power line may extend in substantially a same direction.

In accordance with another embodiment, a method of driving a display device includes applying a gate control signal to a gate control line; applying an auxiliary voltage to an auxiliary power line; and applying the auxiliary voltage to the gate control line by turning on an auxiliary switch electrically connected between the auxiliary power line and the gate control line, wherein the gate control line is electrically connected to at least one pixel of the display device. The auxiliary switch The number is at least one. turned on after the auxiliary voltage is applied to the auxiliary power line. The auxiliary switch The number is at least one. turned on after a voltage for turning on the selection transistor is supplied to the gate control line.

In accordance with another embodiment, an apparatus includes an interface and a controller including or connected to the interface, wherein the controller is to control generation of a first signal to a gate control line, a second signal to a power line, and a third signal to control a switch between the gate control line and the power line, the second signal adding power from the power line to the gate control line to increase a turn on rate of the switch, the gate control line electrically connected to a gate of a transistor of a pixel in a display device.

The controller may output a control signal through the interface to control generation of at least one of the first signal, the second signal, or the third signal. The controller may output a signal to a driver through the interface, the output signal may control the driver to generate the first signal. The controller may output another signal to another driver through the interface, the other output signal may control the other driver to generate the at least one of the second signal or the third signal. The first and third signals may have complementary logical levels.

The transistor may be located between a data line and a driving transistor of the pixel. The turn on rate may be different from a turn off rate of the switch. The turn on rate may be faster than the turn off rate of the switch.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
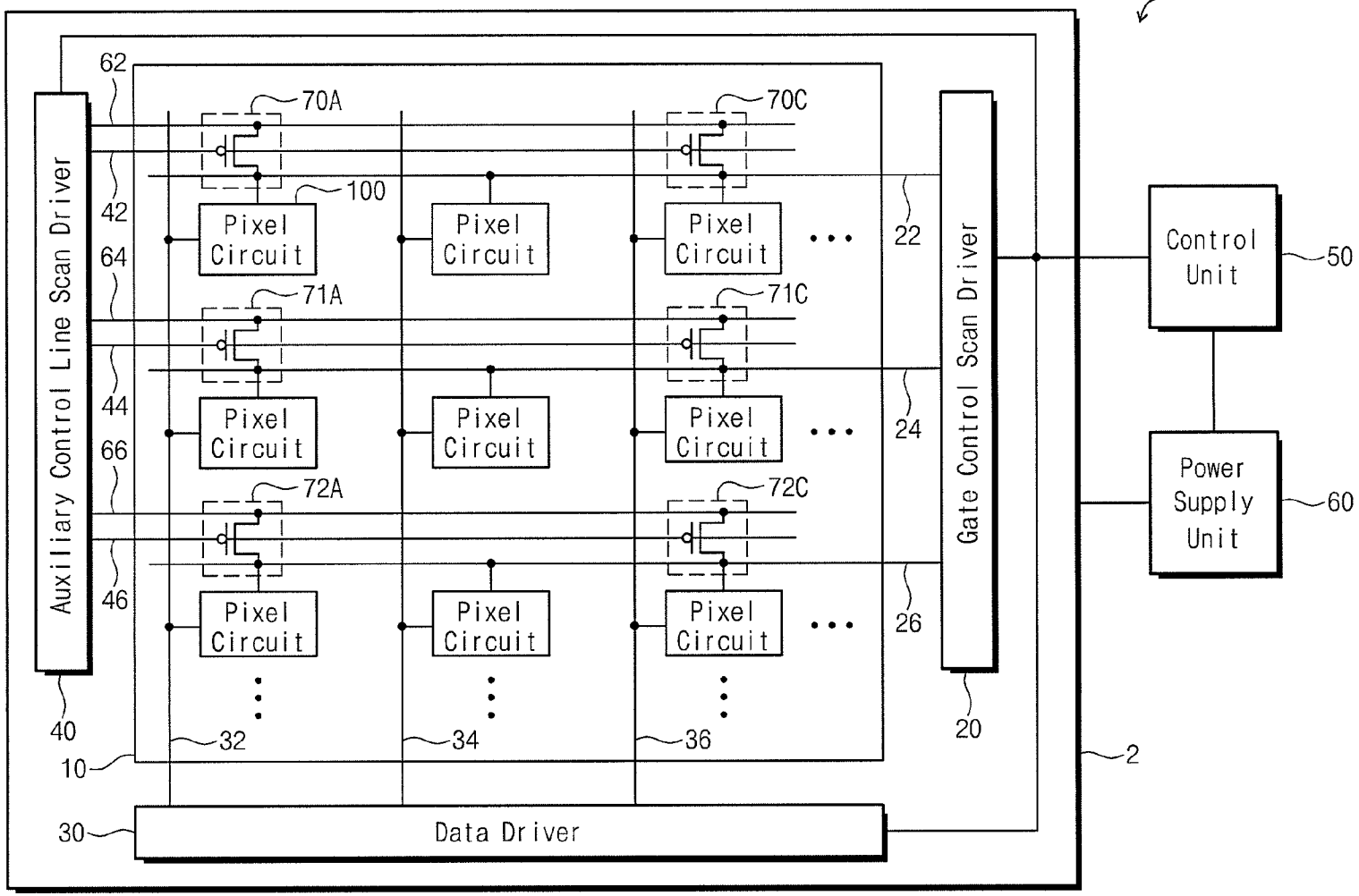
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

FIG. 1 illustrates an embodiment of an electronic apparatus 1 which includes a display device 2, a control unit 50, and a power supply unit 60. The electronic apparatus 1 may be, for example, a television, an electric sign, a personal computer, a smart phone, a tablet PC, a handheld telephone terminal, or another type of electronic device or system.

The display device 2 includes pixel circuits 100 arranged in a matrix and a plurality of auxiliary switches 70A, 70C, 71A, 71C, 72A, and 72C. The pixel circuits 100 and the auxiliary switches 70A, 70C, 71A, 71C, 72A, and 72C are included in the display unit 10.

In the embodiment of FIG. 1, the pixel circuits 100 are configured to be separate from the auxiliary switches 70A, 70C, 71A, 71C, 72A, and 72C. In an alternative embodiment, the pixel circuits 100 may include all or a portion of the auxiliary switches 70A, 70C, 71A, 71C, 72A, and 72C.

Also, the pixel circuits 100 are arranged in a matrix. For example, in FIG. 1, the pixel circuits 100 are arranged in an n-by-m matrix (n=1, 2, 3 . . . , and m=1, 2, 3 . . . ). For example, when n=3, pixel circuits 100 are disposed in three rows. When m=3, pixel circuits 100 are disposed in three columns. The values of m and n may be different in other embodiments. Also, the pixel circuit 100 may be arranged in a rectangular pattern (e.g., n≠m) or a pattern different from a matrix in other embodiments.

Each pixel circuit 100 includes a pixel, which includes, for example, a light-emitting element 86A, a driving transistor 82A, and a selection transistor 80A. These features will be described in greater detail with reference to FIG. 3.

To display images, the display device 2 controls the light-emitting element 86A of each pixel circuit 100 to emit light. The light-emitting element 86A may include, for example, a light-emitting diode. In one embodiment, the light-emitting diode may be an organic light-emitting diode (OLED). In other embodiments, the light-emitting diode may be another type having a rectification characteristic.

The control unit 50 includes a central processing unit for controlling operation of the display unit 2. The control unit 50 may include or be coupled to an interface for through which one or more signals are output to the display. The interface may be, for example, one or more pins of a chip which includes the control unit 50. Additionally, or alternatively, the interface may be one or more signal lines between the control unit 50 and the display.

The control unit 50 controls a gate control scan driver 20, a data driver 30, and an auxiliary control scan driver 40. Based on input image data, the control unit 50 determines gray scale values for an image to be displayed. The light-emitting diodes of the pixel circuits 100 then emit light to generate the image based on data voltages (e.g., gray scale data voltages) that correspond to the gray scale values. That is, the control unit 50 may control a light-emitting diode of each pixel circuit 100 through the above-described operations. The control unit may include or be coupled to a memory. The memory may include code or instructions to be executed by the control unit 50 in generating signals for controlling the drivers, including generation from the drivers of the gate control signals, auxiliary control signals, and auxiliary power signals discussed in greater detail below. Additionally, or alternatively, the code or instructions may be stored in any type of computer-readable medium for implementing the operations discussed herein.

The power supply unit 60 supplies power to the electronic apparatus 1. For example, the power supply unit 60 may supply power to the display device 2 and the control unit 50. In the display device 2, the power supply unit 60 supplies current that flows from an anode to a cathode of a light-emitting diode of each pixel circuit 100. For example, the power supply unit 60 may supply an anode voltage ELVDD and a cathode voltage ELVSS. Also, the power supply unit 60 may supply an auxiliary voltage to the auxiliary power lines 62, 64, and 66.

The pixel circuits 100 are controlled by the gate control scan driver 20, the data driver 30, and the auxiliary control scan driver 40. The gate control scan driver 20 controls the selection transistor 80A of the pixel, the data driver 30 supplies gray scale data to be provided to the pixel, and the auxiliary control scan driver 40 controls the auxiliary switch 70A of each pixel circuit 100.

The gate control scan driver 20 sequentially selects a row to be written with data according to a predetermined order. For example, the gate control scan driver 20 supplies a gate control signal to the gate control lines 22, 24, and 26 corresponding to rows of the pixel circuits 100. In one embodiment, the gate control signal may control the selection transistor 80A to electrically connect the driving transistor 82A and the data lines 32, 34, and 36.

The data driver 30 supplies a gray scale data voltage to the pixel circuits 100 via the data lines 32, 34, and 36 corresponding to columns of the pixel circuits 100. The data driver 30 may sequentially provide gray scale data to pixel circuits 100 which are electrically connected to a selected gate control line.

The auxiliary control scan driver 40 may not only supply an auxiliary control signal to the auxiliary control lines 42, 44, and 46 corresponding to rows of the pixel circuits 100, but may also provide auxiliary power to the auxiliary power lines 62, 64, and 66 corresponding to rows of the pixel circuits 100. The auxiliary control lines 42, 44, and 46 and the auxiliary power lines 62, 64, and 66 are electrically isolated from the gate control lines 22, 24, and 26. In one embodiment, the auxiliary control lines 42, 44, and 46, the auxiliary power lines 62, 64, and 66, and the gate control lines 22, 24, and 26 may extend in the same direction.

The auxiliary control lines 42, 44, and 46 may be used to control the auxiliary switches 70A, 70C, 71A, 71C, 72A, 72C (refer to FIG. 3) disposed between the gate control lines 22, 24, and 26 and the auxiliary power lines 62, 64, and 66. In one embodiment, the auxiliary control lines 42, 44, and 46 may be sequentially and exclusively selected according to a predetermined order. The auxiliary switches 70A, 70C, 71A, 71C, 72A, 72C do not need to be disposed per pixel circuit. For example, in one embodiment, at least one auxiliary switch may be disposed per each row.

Figure 2:
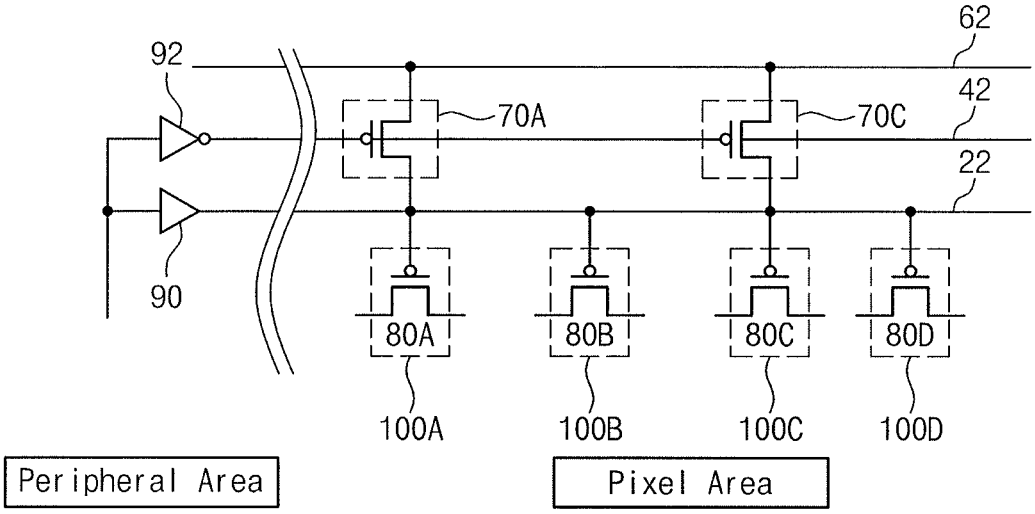
FIG. 2 illustrates a connection between gate and auxiliary control lines.

FIG. 2 illustrates an example of a connection between the gate control line 22 and one or more of the auxiliary control lines in FIG. 1. Referring to FIG. 2, selection transistors 80A to 80D of the pixel circuits 100A to 100D are electrically connected to the gate control line 22. As illustrated in FIG.

3, one pixel circuit 100 may optionally include a plurality of elements, e.g., a driving transistor 82A, a light-emitting element 86A, and so on.

In FIG. 2, selection transistors 80A to 80D and auxiliary switches 70A and 70C are p-channel transistors. The gate control line 22 extends in a row direction of the pixel circuits 100 arranged in a matrix, and is electrically connected to the selection transistors 80A to 80D of the pixel circuits 100. An auxiliary control line 42 and an auxiliary power line 62 may extend in the same direction as the gate control line 22. The auxiliary control line 42 is electrically connected to gate electrodes of the auxiliary switches 70A and 70C, which are disposed between the gate control line 22 and the auxiliary power line 62.

In one embodiment, the auxiliary switches 70A and 70C may be connected to one of each pair of pixel circuits 100. In an alternative, the auxiliary switches may be connected in one-to-one correspondence with the pixel circuits 100. In another alternative embodiment, one auxiliary switch may be provided for every ten, one hundred, or a different number pixel circuits. In another alternative embodiment, one auxiliary switch may be disposed per one or more rows.

In FIG. 2, the auxiliary control line 42 is disposed between the gate control line 22 and the auxiliary power line 62. In another embodiment, the auxiliary control line 42, the gate control line 22, and the auxiliary power line 62 may be disposed in a different order or layout.

As illustrated in FIG. 2, the gate control line 22 and the auxiliary control line 42 are electrically connected to a buffer 90 and an inverter 92, respectively. The buffer 90 and the inverter 92 may be located in a peripheral area. Complementary signals may be supplied to the gate control line 22 and the auxiliary control line 42. For example, a gate control signal with a high level may be supplied to the gate control line 22 to turn off the selection transistors 80A to 80D. For example, when the selection transistors 80A to 80D are turned off, a low-level signal is applied to the auxiliary control line 42 to turn on the auxiliary switches 70A and 70C. (Voltages for turning on and off the selection transistors 80A to 80D and the auxiliary switches 70A and 70C may be referred to as turn-on and turn-off voltages, respectively).

Figure 4:
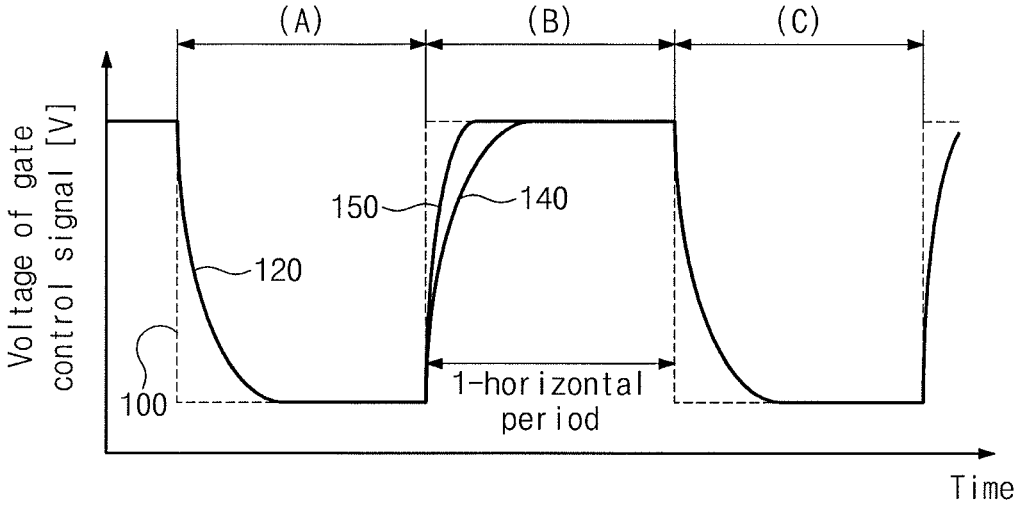
FIG. 4 illustrates an example of the operation of the display device.

FIG. 4 illustrates an example of how the circuit of FIG. 2 may operate. Referring to FIG. 4, a graph is illustrated which includes a square wave 110 indicated by a dotted line. The square wave 110 represents an ideal gate control signal generated by the gate control scan driver 20. The waveform 120 represented by a solid line is a gate control signal that is measured at a point on a gate control line 22 farthest away from a point on the gate control line 22 to which a gate control signal is supplied. In the graph of FIG. 4, a gate control signal transitions from a high level to a low level, and from a low level to a high level, based on horizontal period.

In the graph of FIG. 4, the horizontal axis represents time, and the vertical axis represents the voltage of the gate control signal. In period (A) of FIG. 4, the gate control signal applied to the gate control line 22 transitions from a high level to a low level, in order to turn on selection transistors 80A to 80D that have been turned off. Also, a signal having the same level as the gate control signal is applied to an auxiliary control line 42 via an inverter. A voltage applied to the auxiliary control line 42 changes from a low level to a high level. Thus, auxiliary switches 70A and 70C are controlled by the auxiliary control line 42 to turn off.

The gate control line 22 may have parasitic capacitance as a result of the selection transistors 80A to 80D electrically connected thereto, or a cross point of the gate control line 22 and a data line. The gate control line 22 may have a resistance resulting from interconnection material, thickness, and/or width of the gate control line 22.

The waveform 120 of a measured gate control signal may deviate from the ideal square wave 110 as a result of various factors. For example, one fact is RC delay based on the capacitance and resistance of the gate control line, and, in particular, at a point of the gate control line 22 away from the point where the gate control signal is supplied. Thus, as illustrated in FIG. 4, the gate control signal does not immediate change to the low level. Rather, the gate control signal changes to the low level after a period of time (hereinafter, referred to as a falling time) when the gate control signal transitions from a high level to a low level.

A high-level voltage is applied to the auxiliary control line 42. The applied voltage may be a voltage having the same level as a high level of the gate control signal which is basically applied to the gate control line 22. At this time, an auxiliary voltage applied to an auxiliary power line 62 does not affect the gate control line 22. This is because the auxiliary switches 70A and 70C are turned off.

Next, in period (B), a gate control signal applied to the gate control line 22 changes from a low level to a high level, to turn off selection transistors 80A to 80D that have been turned on. A signal having the same level as the gate control signal may be applied to the auxiliary control line 42 via an inverter. The voltage applied to the auxiliary control line 42 changes from a high level to a low level. Thus, the auxiliary switches 70A and 70C is controlled by the auxiliary control line 42 to turn on.

At this time, an auxiliary voltage applied to the auxiliary power line 62 is applied to the gate control line 22 via the auxiliary switches 70A and 70C. As compared to a rising characteristic of a gate control signal 140 of a technique in which auxiliary power is not used, the rising characteristic 150 of the gate control signal according to one embodiment is comparatively sharper. Thus, there is shortened a time (hereinafter referred to as a rising time) taken when the gate control signal has a low-to-high transition according to one embodiment. As a result, the gate control line 22 may be driven at a faster rate.

The auxiliary voltage may be applied to the auxiliary power line 62 before a signal for turning on the auxiliary switches 70A and 70C is applied to the auxiliary control line 42. Also, in one embodiment, a turn-on voltage or a turn-off voltage is supplied to the gate control line 22 and the auxiliary control line 42 almost at the same time.

In another embodiment, the gate control line 22 and the auxiliary control line 42 may be controlled independently from one another. In this case, it is possible to control the gate control line 22 and the auxiliary control line 42 at different timings. For example, a voltage for turning on the auxiliary switches 70A and 70C may be supplied to the auxiliary control line 42 at the same time or after a voltage for turning on the selection transistors 80A to 80D is supplied to the gate control line 22.

In one embodiment, an operation may be performed where the gate control line 22 transitions from a low level to a high level to turn off the selection transistors 80A to 80D previously turned on, at high speed. In another embodiment, a combination of a buffer and an inverter may be arbitrarily selected.

For example, a circuit may turn on the selection transistors 80A to 80D at high speed where the auxiliary switches 70A and 70C and the selection transistors 80A to 80D are p-channel transistors. In this case, signals with the same voltage level are supplied to the gate and auxiliary control lines 22 and 42, to turn on the auxiliary switches 70A and 70C when the selection transistors 80A to 80D are turned on. As a result, an auxiliary voltage applied to the auxiliary power line 62 is supplied to the gate control line 22.

Also, in one embodiment, each of the gate and auxiliary control lines 22 and 42 may be electrically connected to a buffer at a peripheral area. In another embodiment, each of the gate and auxiliary control lines 22 and 42 may be electrically connected to an inverter in a peripheral area. In another embodiment, a signal may be directly supplied without passing through a buffer or an inverter.

Also, a circuit may be provided to turn off the selection transistors 80A to 80D at high speed where the auxiliary switches 70A and 70C and the selection transistors 80A to 80D are n-channel transistors. Like the circuit formed of p-channel transistors, either one of the gate or auxiliary control lines 22 and 42 is electrically connected to an inverter in a peripheral area. An auxiliary voltage applied to the auxiliary power line 62 is provided to the gate control line 22 when the selection transistors 80A to 80D are turned off. (An n-channel transistor is turned on when a high-level signal is applied to a gate control line, and it is turned off when a low-level signal is applied to the gate control line). A circuit formed of n-channel transistors may operate in an analogous manner as a circuit formed of p-channel transistors.

In one embodiment, the auxiliary switches 70A and 70C and the selection transistors 80A to 80D may be of the same conductivity type. In another embodiment, the auxiliary switches 70A and 70C and the selection transistors 80A to 80D may have different conductivity types. For example, the auxiliary switches 70A and 70C may be n-channel transistors and the selection transistors 80A to 80D may be p-channel transistors.

Figure 3:
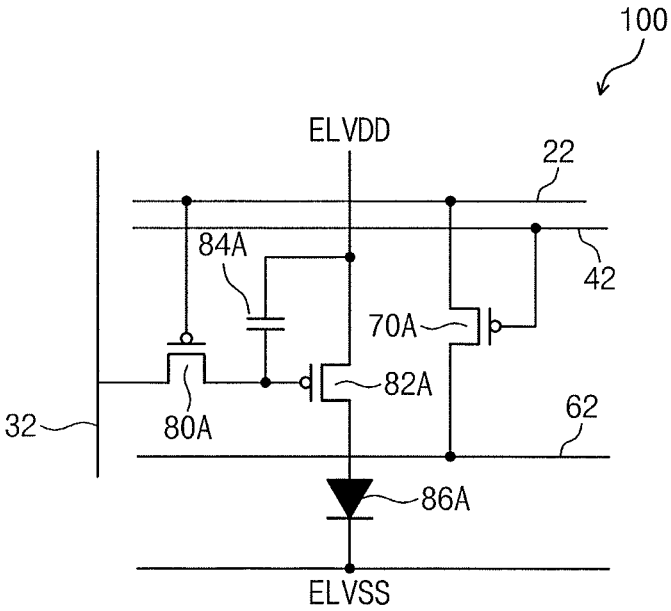
FIG. 3 illustrates an embodiment of a pixel circuit and an auxiliary switch.

FIG. 3 illustrates an embodiment of the pixel circuit 100 and an auxiliary switch in FIG. 1. Referring to FIG. 3, the pixel circuit 100 includes a selection transistor 80A, a driving transistor 82A, a holding capacitor 84A, and a light-emitting element 86A. In FIG. 3, a pixel circuit is illustrated for an organic EL display. An emission transistor may be included, that is electrically connected between the driving transistor 82A and the light-emitting element 86A, to control light-emitting of the light-emitting element 86A. A threshold voltage (VTH) correction circuit may be included where a transistor is disposed between a drain and a gate of the driving transistor 82A. The VTH correction circuit may correct variation in an inherent threshold voltage of the driving transistor 82A.

Interconnection between elements and control lines of the pixel circuit 100 in FIG. 3 will now be described. An auxiliary switch 70A is disposed between a gate control line 22 and an auxiliary power line 62. The auxiliary switch 70A has a gate electrode electrically connected to an auxiliary control line 42.

The selection transistor 80A is disposed between a data line 32 and a gate electrode of the driving transistor 82A, and has a gate electrode electrically connected to the gate control line 22.

The driving transistor 82A has a source electrode electrically connected to an anode voltage ELVDD and a drain electrode electrically connected to an anode-side electrode of the light-emitting element 86A. A cathode-side electrode of the light-emitting element 86A is electrically connected to a cathode voltage ELVSS.

The driving transistor 82A supplies the light-emitting element 86A with a current according to a gray scale data voltage supplied to the gate electrode of the driving transistor 82A. The current determines the intensity of light-emitting of the light-emitting element 86A. The holding capacitor 84A is connected between the gate electrode and a source electrode of the driving transistor 82A. The holding capacitor 84A retains a gray scale data voltage supplied to the gate electrode of the driving transistor 82A. This makes it possible to maintain the intensity of light emitted from the light-emitting element 86A during a light-emitting period.

Figure 5:
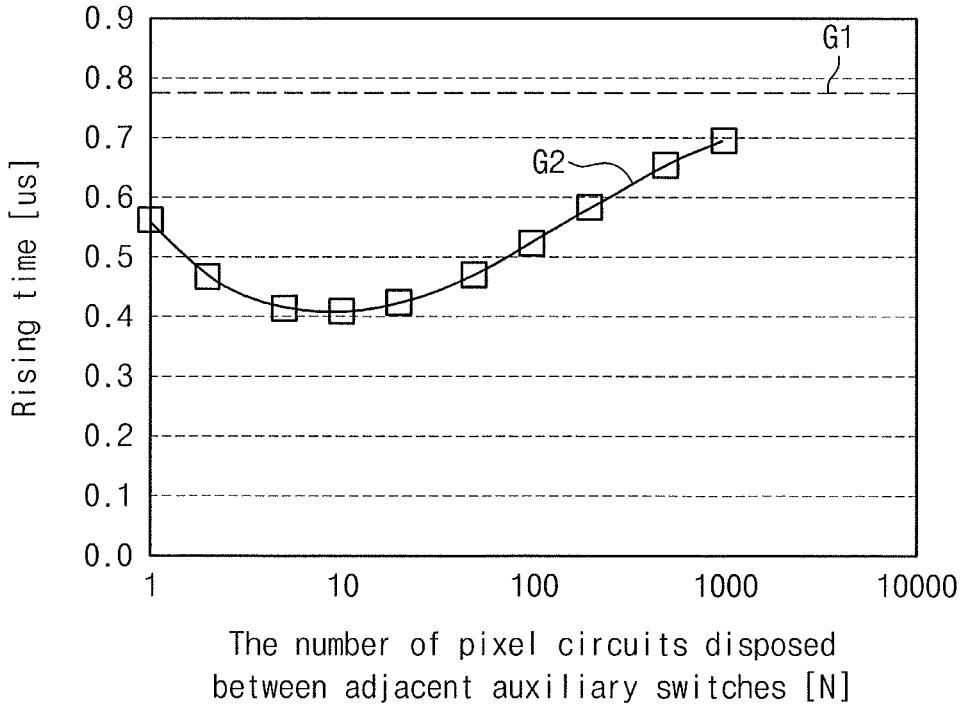
FIG. 5 illustrates simulation results of the operation in FIG. 4.

FIG. 5 illustrates an example of a simulation result for verifying operation of one or more of the aforementioned embodiments. In one embodiment, an auxiliary switch may be disposed for each of N pixel circuits.

In FIG. 5, a relationship exists between a rising time of a gate control signal and a distance between auxiliary switches with respect to pixel circuits arranged in a row direction, e.g., the number of pixel circuits between auxiliary switches adjacent in the row direction.

Table 1 shows parameters used for the simulation.

TABLE 1

| | Gate control line | Auxiliary power line | Auxiliary control line |
|---|---|---|---|
| Resistance | 1.2 Ω/pixel | 0.6 Ω/pixel | 1.2 Ω/pixel |
| Capacitance | 28 pF/pixel<br>Gate capacitance@selection TR/pixel | 56 pF/pixel | 28 pF/pixel<br>Gate capacitance@selection TR/pixel (only, installed pixels) |

For the gate control line, a resistance value is 1.2Ω per pixel circuit and a capacitance value is a sum of gate capacitance of a selection transistor and 28 pF per pixel circuit. For the auxiliary power line, a resistance value is 0.6Ω per pixel circuit and a capacitance value is 56 pF per pixel circuit. For the auxiliary control line, a resistance value is 1.2Ω per pixel circuit and a capacitance value is a sum of gate capacitance of a selection transistor and 28 pF per pixel circuit. The capacitance of the auxiliary control line may be calculated based on the number of pixel circuits, each of which includes an auxiliary switch.

For example, simulated is a 70-inch UD (ultra-definition) display device. A gate control line is electrically connected with about 5000 transistors. Also, as a capacitance parameter of a gate control line, overlapping capacitance between a gate control line and a data line or between the gate control line and a power line and cathode capacitance may be considered.

In FIG. 5, the dotted line G1 represents a rising time of a gate control signal of a circuit in which auxiliary switches are not disposed. The solid line G2 represents a rising time of a gate control signal of a circuit in which auxiliary switches according to one embodiment.

From FIG. 5, under all conditions, the rising time of the gate control signal about a circuit according to the depicted embodiment is faster than the circuit in which auxiliary switches are not disposed.

Also, the simulation result shows that a variation in the rising time of the gate control signal according to a distance between auxiliary switches disposed is very small. For example, the rising time of the gate control signal has a minimum value when an auxiliary switch is disposed for every 10 pixel circuits.

It is therefore possible to supply a voltage at a faster rate as the number of auxiliary switches increases. However, parasitic capacitance of an auxiliary control line may increase due to an increase in the number of auxiliary switches. An increase in parasitic capacitance may cause a delay of the auxiliary control signal, which, in turn, may cause a delay in the operation of the auxiliary switch. In one embodiment, the number of auxiliary switches may be less than the number of pixel circuits in the row direction.

Figure 6:
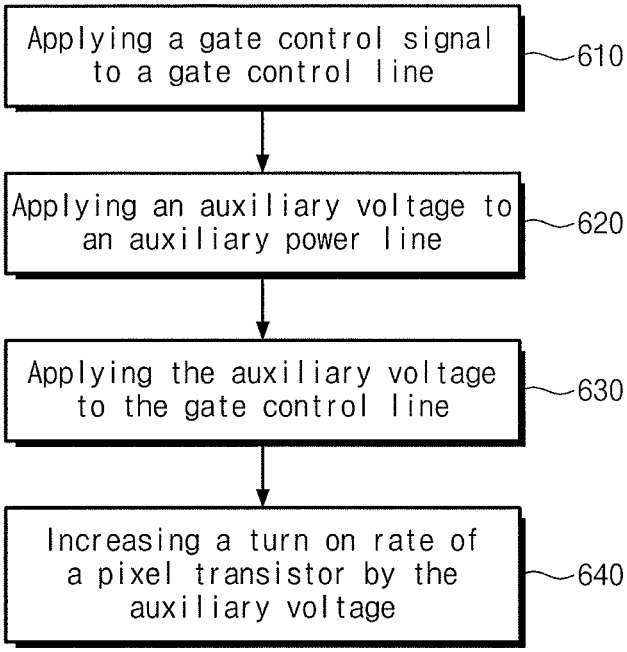
FIG. 6 illustrates operations included in an embodiment of a method for controlling a display device.

FIG. 6 shows operations included in an embodiment of a method for controlling a display device. The method includes applying a gate control signal to a gate control line (S610), applying an auxiliary voltage to an auxiliary power line (S620), applying the auxiliary voltage to the gate control line by turning on an auxiliary switch electrically connected between the auxiliary power line and the gate control line (S630), and increasing a turn on rate of a pixel transistor based on the auxiliary voltage (S640). The gate control line may be electrically connected to at least one pixel of the display device. The auxiliary switch may be turned on after the auxiliary voltage is applied to the auxiliary power line. The auxiliary switch may be turned on after a voltage for turning on a selection transistor is supplied to the gate control line.

By way of summation and review, the resolution of displays must increase in order to meet market demand for better picture quality. According to one approach, the number of pixels of a display device (e.g., resolution) may be increased, but the frame frequency used to display images does not change. The time taken to write image data is therefore short as a result of the increased number of pixels.

In accordance with one or more of the aforementioned embodiments, the gate control signals may be applied at faster rate in order to operate within the shortened time for writing image data. For example, the number of auxiliary switches or a distance between the auxiliary switches may be optimized to achieve the faster rate. To achieve this faster rate, an auxiliary switch may be disposed in such a way that m pixel circuits (m being an integer more than 1 and less than 50) are arranged between adjacent auxiliary switches. Also, n pixel circuits (n being an integer more than 5 and less than 20) may be arranged between adjacent auxiliary switches.

In accordance with these or other embodiments, because a pixel circuit includes a pixel, the number of auxiliary switches may be less than the number of pixels in the row direction. For example, n pixel circuits (n being an integer more than 5 and less than 20) may be arranged between adjacent auxiliary switches.

In accordance with these or other embodiments, the selection transistors and auxiliary switches may be p-channel transistor and a gate control signal may rise at high speed. In another embodiment, the selection transistors and auxiliary switches may be n-channel transistors. In another embodiment, n-channel transistors made to operate as p-channel transistors by changing the level of the signals supplied to gate and auxiliary control lines. In another embodiment, the selection transistors and auxiliary switches may be formed from a combination of p-channel transistors and n-channel transistors. In these cases, it is possible to make a gate control signal fall at high speed, and/or it is possible to make a gate control signal rise and fall at high speed. That is, a falling time or a rising time of a gate control line may be reduced.

Thus, a gate control line may be driven at high speed by supplying a gate control voltage to a gate control line in a pixel area through an auxiliary switch.

The methods and processes described herein may be performed by code or instructions to be executed by a computer, processor, or controller. Because the algorithms that form the basis of the methods (or operations of the computer, processor, or controller) are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a plurality of pixels;

a gate control line electrically connected to the pixels;

an auxiliary power line isolated from the gate control line;

an inverter connected between the gate control line and an auxiliary control line; and a number of auxiliary switches between the gate control line and the auxiliary power line, wherein the at least one auxiliary switch is to be controlled by the auxiliary control line isolated from the auxiliary power line and the gate control line, and wherein the at least one auxiliary switch electrically connects the gate control line and the auxiliary power line, wherein signals supplied to the gate control line and the auxiliary control line are complementary signals.

2. The display device as claimed in claim 1, wherein the number of the auxiliary switches is less than a number of the pixels.

3. The display device as claimed in claim 2, wherein one of the auxiliary switches is provided for every N pixels, where N is an integer more than 5 and less than 20.

4. The display device as claimed in claim 1, wherein each of the pixels includes:

a light-emitting element; and a driving transistor is to control an amount of current flowing to the light-emitting element to achieve to a corresponding gray scale value.

5. The display device as claimed in claim 1, wherein:

each of the pixels includes a selection transistor controlled by the gate control line, and signals supplied to the selection transistor and the auxiliary switches during a horizontal period are different from each other.

6. The display device as claimed in claim 1, wherein:

each of the pixels includes a selection transistor controlled by the gate control line, and signals supplied to the selection transistor and each gate electrode of the auxiliary switches during a horizontal period are substantially equal to each other.

7. The display device as claimed in claim 1, wherein:

an auxiliary voltage is applied to the auxiliary power line before a signal for turning on the auxiliary switches is supplied to the auxiliary control line.

8. The display device as claimed in claim 1, wherein the gate control line, the auxiliary control line, and the auxiliary power line extend in substantially a same direction.

9. The display device as claimed in claim 1, wherein the number is at least one.

10. A method of driving a display device, the method comprising:

applying a gate control signal to a gate control line;

applying an auxiliary voltage to an auxiliary power line;

applying a complementary signal to an auxiliary control line by inverting a signal on the gate control line; and applying the auxiliary voltage to the gate control line by turning on an auxiliary switch electrically connected between the auxiliary power line and the gate control line in response to the complementary signal on an auxiliary control line, wherein the gate control line is electrically connected to at least one pixel of the display device.

11. The method as claimed in claim 10, wherein the auxiliary switch is turned on after the auxiliary voltage is applied to the auxiliary power line.

12. The method as claimed in claim 11, wherein the auxiliary switch is turned on after a voltage for turning on a selection transistor is supplied to the gate control line.

13. An apparatus, comprising:

an interface; and a controller including or connected to the interface, wherein the controller is to control generation of a first signal to a gate control line, a second signal to a power line, and a third signal to control a switch between the gate control line and the power line, the second signal adding power from the power line to the gate control line to increase a turn on rate of the switch, the gate control line electrically connected to a gate of a transistor of a pixel in a display device, wherein the first and third signals are complementary signals.

14. The apparatus as claimed in claim 13, wherein the controller outputs a control signal through the interface to control generation of at least one of the first signal, the second signal, or the third signal.

15. The apparatus as claimed in claim 13, wherein the controller outputs a signal to a driver through the interface, the output signal to control the driver to generate the first signal.

16. The apparatus as claimed in claim 13, wherein the controller outputs another signal to another driver through the interface, the other output signal to control the other driver to generate the at least one of the second signal or the third signal.

17. The apparatus as claimed in claim 13, wherein the first and third signals have complementary logical levels.

18. The apparatus as claimed in claim 13, wherein the transistor is located between a data line and a driving transistor of the pixel.

19. The apparatus as claimed in claim 13, wherein the turn on rate is different from a turn off rate of the switch.

20. The apparatus as claimed in claim 19, wherein the turn on rate is faster than the turn off rate of the switch.

* * * * *